United States Patent [19]

Husain

[11] 4,392,935

[45] Jul. 12, 1983

[54] DISTRIBUTED FORCE INDEXING SYSTEM

[75] Inventor: Syed A. Husain, San Jose, Calif.

[73] Assignee: National Semiconductor Corporation, Santa Clara, Calif.

[21] Appl. No.: 426,509

[22] Filed: Sep. 29, 1982

[51] Int. Cl.[3] ..... C25D 17/00

[52] U.S. Cl. ..... 204/206; 204/224 R

[58] Field of Search ..... 204/206, 224 R, 225

[56] References Cited

U.S. PATENT DOCUMENTS 3,723,283 3/1973 Johnson ..... 204/225

3,860,499 1/1975 Graham ..... 204/224 R 3,977,957 8/1976 Kosowsky ..... 204/224 R

*Primary Examiner*—T. M. Tufariello

*Attorney, Agent, or Firm*—Neil B. Schulte; Paul J. Winters; Gail W. Woodward

[57] ABSTRACT

An indexing system adapted to periodically advance a web of metal through a plating line that first advances gently till it engages a hole in the web, then closes clamping members about the web to grasp the web over a distributed region, and only then moves the web at full speed.

5 Claims, 1 Drawing Figure

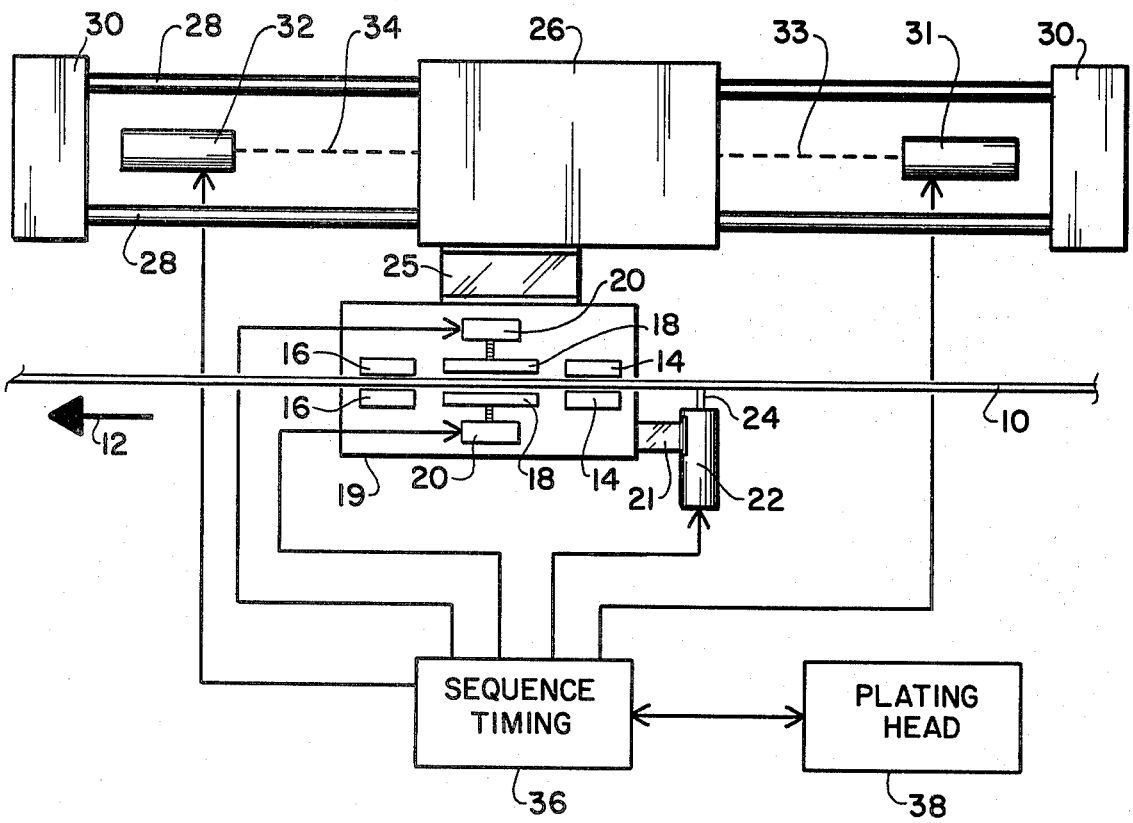
30
28
32
34
26
33
31
30
28
25
20
18
16
14
16
24
10
12
19
20
18
14
21
22
SEQUENCE TIMING
PLATING HEAD
36
38

DISTRIBUTED FORCE INDEXING SYSTEM

BACKGROUND OF THE INVENTION

U.S. Pat. No. 3,723,283 comprehensively described a typical prior art system for plating metal onto selected portions of a moving strip of lead frame. Lead frame comprises a long strip of metal, sometimes delicate in structure, that is plated in various ways and then cut into small segments to form leads for electronic components such as integrated circuits. The above noted patent shows how the strip of lead frame is periodically advanced through the plating heads so subsequent portions of the strip may be plated. This physical movement, called indexing, is traditionally accomplished by inserting a pin into one of a series of holes in the edge, or rail, of the lead frame, and stroking it forward a set distance. However, as lead frames have become smaller and finer in structure, the forces of a pin pushing against the side of a tiny hole can become too concentrated to be borne by the delicate structure of the lead frame.

SUMMARY OF THE INVENTION

Briefly, the present invention permits the indexing of fragile strips of lead frame by grasping the rails thereof over a larger distributed area as opposed to the prior art concentration of force at one spot. Clamping members close on the rail and grasp it firmly over a distributed area, thus, avoiding damage to the lead frame. To insure that the clamping members grasp the rail in exactly the right location, as was guaranteed in the past by inserting a pin in a precisely positioned hole, the present invention first allows a clamp mounted pin to slowly search for and gently enter a hole in the rail. After entry, the relative positioning of the rail and clamps is assured. At that time the clamps close on the rail and the stronger indexing force is applied.

BRIEF DESCRIPTION OF THE DRAWING

The drawing schematically shows the major structural components of the distributed force alignment and application system for indexing the lead frame.

DESCRIPTION OF THE PREFERRED EMBODIMENT

A portion of the strip of metal to be plated is shown from the edge on in the drawing, identified as strip 10. Strip 10 is periodically indexed or moved to the left, as shown by arrow 12. Strip 10 is located by guides 14 and 16 so as to travel between a pair of clamping members 18. Members 18 are positioned and shaped to clamp the edge or rail of strip 10 over an area sufficiently distributed to avoid any localized concentrations of force on strip 10 that could cause damage. Clamping members 18 are moved against strip 10 by actuators 20 operating through suitable mechanical connections shown as dashed lines in the drawing. Actuators 20 could be, for example, air pressure operated or solenoid operated.

Clamps 18, actuators 20, and guides 14 and 16 are mounted on a platform 19 that also supports, by means of an extension bracket 21, a spring loaded pin 24 in a pin guide retractor 22. Retractor 22 may be solenoid or air pressure operated as well, so that pin 24 can be withdrawn from strip 10 when desired.

Platform 19 and hence all the components mounted to it, is connected with a bracket 25 to a sliding shuttle 26. Shuttle 26 is, in turn, adapted to slide back and forth, along the indexing direction, on suitable guides such as rods 28. Rods 28 extend between a pair of supports 30. Movement of shuttle 26 along guide rods 28 is effected by a double acting air cylinder shown schematically in the drawing as a pair of opposed air cylinders 31 and 32 that connect to shuttle 26 through conventional linkages 33 and 34.

All of the various motions are coordinated and controlled by a suitable sequence timing means 36 which could compromise, for example, a microprocessor in sophisticated schemes or simple limit switches in less complicated embodiments. Whatever approach is elected, the sequencer 36 works in cooperation with the plating head portion of the system 38 as described hereinafter.

In operation, assume the plating head 38 has completed plating a section of strip 10, and opened up to allow indexing of strip 10. The rest position of shuttle 26 is chosen so that pin 24 is just to the right of a selected hole in the rail of strip 10. Retractor 22 is not activated, so pin 24 is springably urged against strip 10. Sequencer 36 receives a signal from plating heads 38 indicating that they are open and indexing is required. Sequencer 36 causes air cylinders 31 and 32 to both push on shuttle 26. However, cylinder 31 is caused to have a few pounds greater pressure so that shuttle 26 is moved gently to the left. Nearly balanced pressures on both sides of shuttle 26 guarantee smooth movement of shuttle 26.

After a short distance, pin 24 reaches and drops into the hole in the rail of strip 10 which physically halts shuttle 26 at the exact right location. Shortly thereafter, either in response to a feedback signal indicating pin engagement, or else a simple elapsed time signal, sequencer 36 causes actuators 20 to close clamping members 18 on strip 10. Members 18 now hold the strip so that strain between pin 24 and strip 10 is relieved. Sequencer 36 next raises the pressure in cylinder 31 substantially to provide the main indexing force. Shuttle 26 moves quickly to the left, carrying strip 10 with clamps 18, and comes to a stop after a precise distance determined by physical stops not shown in the drawing. At the end of this stroke, sequencer 36 withdraws pin 24 from the hole in strip 10, opens clamps 18, and adjusts the pressures in cylinders 31 and 32 so as to move shuttle 26 back to the right along guides 28 until shuttle 26 is stopped at a rest position with pin 24, again, just to the right of a selected indexing hole.

The plating heads 38 are closed on strip 10 during the return of the shuttle 26 so as to insure against frictional drag from, say, guides 14 and 16 accidentally moving strip 10 backwards. When plating is completed, the cycle repeats.

Of course, many variations are possible without departing from the spirit and scope of the invention. Sequencer 36 may use simple timing signals to sequence or positive feedback signals from monitors. The physical structure of the movement mechanism, especially the members 19, 21, 25 and 26, can vary significantly. Actuating mechanisms 20, 22, 31 and 32 are also easily replaced with substitute devices. Hence, I intend to be limited only to the system concept as defined in the appended claims.

What is claimed is:

1. In a plating system that intermittently advances a web of material through plating heads that plate metal onto the web, an indexing system for intermittently moving the web comprising in combination:

shuttle means adapted for movement back and forth alongside said web;

hole engaging means connected to said shuttle means in a position to engage holes in said web;

web grasping means operable to grasp said web over a distributed area so as to avoid concentrations of force at any one spot, said grasping means also connected to said shuttle means so as to move therewith and with said hole engaging means;

shuttle moving means operable to move said shuttle with varying degrees of force; and sequencing means connected to control said moving means so as to apply a gentle force to the shuttle when the engaging means is engaging a hole and a greater force to the shuttle after the grasping means has grasped the web.

2. The system of claim 1 in which said hole engaging means comprises a spring loaded pin adapted to springably enter a hole in the web unless held in a retracted position by a retracting means and in response to a retracting signal from said sequencing means.

3. The system of claim 1 in which said shuttle moving means comprises first actuating means urging the shuttle forward, in the direction of web advance, and second actuating means urging the shuttle backwards, said actuating means being controlled by said sequencing means so as to apply a small differential force to the shuttle for achieving said gentle force and a larger differential force for said greater force.

4. The system of claim 3 in which said hole engaging means comprises a spring loaded pin adapted to springably enter a hole in the web unless held in a retracted position by a retracting means and in response to a retracting signal from said sequencing means.

5. The system of claim 4 in which said first and second actuating means comprise air operated cylinders.

* * * * *